US005342649A

United States Patent [19]

Sarokin

[11] Patent Number: 5,342,649

[45] Date of Patent: Aug. 30, 1994

[54] COATED BASE PAPER FOR USE IN THE MANUFACTURE OF LOW HEAT THERMAL PRINTING PAPER

[75] Inventor: Steven D. Sarokin, Green Bay, Wis.

[73] Assignee: International Paper Company, Purchase, N.Y.

[21] Appl. No.: 5,029

[22] Filed: Jan. 15, 1993

[51] Int. Cl.[5] ..... B41M 3/12; B41M 5/40

[52] U.S. Cl. ..... 427/150; 427/151; 427/152; 427/180; 427/365; 503/200; 503/207; 503/214

[58] Field of Search ..... 427/180, 256, 288, 150–152, 427/365; 428/195, 206, 211, 341, 914; 503/227, 200, 207, 214

[56] References Cited

U.S. PATENT DOCUMENTS 3,293,114 12/1966 Kenaga et al. ..... 162/168
4,477,518 10/1984 Cremona et al. ..... 428/327
4,798,820 1/1989 Yaguchi et al. ..... 428/484 X

FOREIGN PATENT DOCUMENTS 0005093 1/1984 Japan ..... 503/207
59-105775 5/1984 Japan ..... 503/226

*Primary Examiner*—B. Hamilton Hess
*Attorney, Agent, or Firm*—Luedeka, Neely & Graham

[57] ABSTRACT

A base paper for use in the manufacture of printing paper used in low heat thermal printing operations. The base paper is provided by coating a paper sheet with a dispersion comprising hollow gas-containing spherical particles preferably of a synthetic polymer, a filler of clay particles, and a binder. The coating provides pigment, thermal insulation and aqueous holdout for a thermosensitive recording layer applied onto the coating and can be calendered to improve surface smoothness.

11 Claims, No Drawings

COATED BASE PAPER FOR USE IN THE MANUFACTURE OF LOW HEAT THERMAL PRINTING PAPER

BACKGROUND OF THE INVENTION

The present invention relates generally to a surface-treated paper product which provides a substrate for receiving a thermosensitive recording layer and which is suitable for use in low heat thermal printing operations. More particularly, the present invention is directed to such a substrate wherein a surface of a paper sheet or support is coated with a single layer of a pigment-containing, thermal insulating composition that is positionable between the paper sheet and the thermosensitive recording layer.

The utilization of heat sensitive recording materials in printing operations for providing selected images on a paper-supported heat sensitive layer through the use of heat pens or thermal printing heads such as used in facsimile machines is becoming of increasing importance in the communications field. Basically, image reproduction in facsimile machines and other thermal printers is achieved by passing a sheet of paper coated with a thermosensitive recording layer containing one or more layers of heat-fusible inks or a dye and a heat sensitive developer in a suitable binder in close proximity to a thermal printing head so that recording signals provided to the thermal printing head can direct selected patterns of heat onto the thermosensitive recording layer for creating the desired image therein.

During early stages in the development of heat sensitive recording papers, it was found that the thermal recording sensitivity of various thermosensitive recording layers on the paper could be enhanced by placing layers of fillers and pigments between the thermosensitive recording layer and the paper support. These intermediate layers improved image contrast, surface smoothness, and reduced heat transfer between the thermosensitive recording layer and the paper support. With the use of such intermediate layers the thermal printing head could be maintained in a close proximity to the thermosensitive recording layer during the printing operation while permitting a large part of the heat from the thermal printing head to be concentrated in the thermosensitive recording layer. These improvements in thermal sensitive recording papers resulted in increased recording speeds and image sharpness so as to render heat sensitive printing a more viable recording practice.

Heat sensitive recording papers employing one or more layers incorporating pigments, fillers and/or thermal insulating materials and which are located between a paper support and a thermosensitive recording layer are described in the literature including U.S. Pat. No. 4,798,820, issued Jan. 17, 1989, European Patent Application No. 0281315, published May 23, 1989, Japanese "Kokai" Patents Nos. Sho 60--284390, published Dec. 9, 1985, and Sho 62-5586, published Jan. 12, 1987, and Japanese Patent Publication No. 84-04520/80, published Jan. 11, 1984.

While these previous developments resulted in improved heat sensitive recording papers, these papers were found to be primarily useful in thermal printers utilizing relatively high levels of heat at the thermal printing heads for developing the thermal image. In as much as the majority of the thermal printers presently in use are of the types using medium and high heat at the thermal printing heads, these heat sensitive recording papers are currently in demand. However, when using these previously provided heat sensitive recording papers in thermal printers using relatively low heat levels at the thermal printing heads, the image density produced on the thermosensitive recording layer was often less than that obtained when using the same heat sensitive recording papers in medium and high heat thermal printers. Thus, with a recent trend in thermal printers moving towards the use of thermal printers using less heat at the thermal printing heads in order to promote faster printing speeds there is presently a need for a coated base paper, which when provided with a coating of a suitable thermosensitive recording composition, can provide a satisfactorily high level of image density when used in lower heat thermal printers.

SUMMARY OF THE INVENTION

Accordingly, it is an object of the present invention to provide a base paper for use in the manufacture of heat sensitive printer paper useful in thermal printers operating at relatively low levels of energy or heat wherein the base paper facilitates the development of high density printing images in a thermosensitive recording layer applied to a coated surface of the base paper.

Another object of the present invention is to provide such a base paper by coating a paper support with a single layer of a composition or formulation formed of a mixture of thermoplastic gas-containing microspheres, clay particulates, and binder so as to provide a satisfactory level of aqueous holdout for a thermal sensitive recording layer applied thereon and to provide sufficient thermal insulating properties for assuring that the heat transfer to the thermal printing paper from low heat printing heads will be concentrated in the thermosensitive recording layer to provide printed images of adequate density.

Generally, these and other objects of the present invention are achieved by providing a base coated paper substrate for use in the manufacture of thermal printing paper useful in low heat thermal printing operations with the base coated paper providing the support for the thermosensitive recording layer. The coated paper substrate comprises a paper base in sheet form having opposite essentially flat surfaces and a single coating applied to one of the flat surfaces. The coating is used to provide a pigment-containing thermal insulating and aqueous holdout layer onto which there is subsequently applied a thermosensitive recording layer. The coating is formed of a thermal insulating dispersion comprising: pigment-providing hollow gas-containing spherical particles of a diameter less than 1 micron and provided by a synthetic polymer of the type represented by styrene acrylic co-polymer, glass bubbles, or structured clay; a pigment-providing filler formed of clay particulates of different particle sizes, preferably provided by two clays of different particle size and of the same or different types of clay, and selected from the class of pigments comprising, kaolin, China clay, delaminated clay, structured clay, carbonate and titanium dioxide, and a binder selected from styrene butadiene, acetate acrylic, vinyl acetate, polyvinyl alcohol starch and casein protein. Other suitable binders and/or pigments will be recognized by one skilled in the art, given the examples presented above and further described herein. Spherical particles, as opposed to non-spherical particles are preferred by reason of their predictable uniformity of size, good rheological properties, and because they entrap the air efficiently.

The coating is applied to a flat surface of the paper base in an amount adequate to substantially uniformly cover the flat surface with a coating of a thickness having a coating weight based on dry weight of about 2.0 to 10 lbs per 3000 $ft^2$ of paper surface.

The coated paper base forming the substrate is preferably calendered at a relatively low nip pressure for improving the surface smoothness and the density of the coating. The hollow spherical particles are sufficiently plastic so that during laydown and the calendering operation they maintain their structural identity.

Other and further objects of the present invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE INVENTION

As briefly described above, the present invention is directed to a coated paper product which provides a base paper or substrate for a thermosensitive recording layer and is particularly suitable for use in low energy thermal printing operations utilizing energy levels in the range of about 100 watts in the copy mode.

The particular composition of the thermosensitive recording layer applied over the coating on the paper substrate is not part of the present invention and may be provided by using any suitable thermosensitive recording composition such as described in the aforementioned patents or as set forth below.

The coated paper substrate of the present invention is provided by coating one surface of a paper support with a layer primarily formed of a dispersion of hollow gas-containing spherical particles, preferably thermoplastic, having a particle size of less than 1 micron, a particulate filler, and a binder. The spherical particles and the particulate filler provide the pigment necessary to form and maintain a background of sufficient whiteness to achieve desired clarity of the thermally printed image. It is to be recognized that the spherical particles commonly contain liquid during the time when they are being deposited on the paper base, but this liquid is replaced with air during drying of the coating on the paper base.

The paper base or support upon which the thermal-insulating coating is applied can be of any commercially available type suitable for thermal printing operations and characterized by high quality, uniformity in thickness, and of a basis weight preferably in the range of about 20 to 35 lb per 3000 $ft^2$, but papers of other basis weights can be used as the end use demands. The paper preferably is formed from a web of one or more types of cellulosic papermaking fibers. The paper may also be calendered, if amenable, to improve surface smoothness.

The coating formulation of the present invention, when applied to one surface of the paper base, thermally insulates the thermosensitive recording layer applied over the coating from the coating and the paper base and thereby concentrates available heat from the thermal printing heads in the thermosensitive recording layer for image development purposes. Such concentration of available heat in the thermosensitive recording layer prevents the heat from being "wasted" in the coated paper substrate so as to provide good image density during low energy therehal printing operations. The hollow gas-containing spherical particles provide closed gas-filled cells or voids in the coating to provide the thermal insulating properties. As will be described below, the concentration of these hollow spherical particles in the coating has a direct bearing on the image density achieved during thermal printing operations at low energy since it was generally found that as the thermal insulating properties of the coating were increased so was the image density.

The coating also provides a high level of aqueous holdout of the thermosensitive recording layer so as to prevent portions of the thermosensitive recording layer from penetrating too far into the thermal insulation coating and thereby preventing these portions of the thermosensitive recording layer from receiving adequate exposure to the heat applied during thermal printing operations. With the coating of the present invention providing sufficient holdout to minimize penetration of thermosensitive recording layer thereinto, a reduction in the quantity of the relatively expensive composition used for forming the thermosensitive recording layer needed for achieving desired image densities can be realized.

The composition of the present coating applied to the paper base serves as a thermal insulating layer and simultaneously as a hold-out layer for the subsequently-applied thermosensitive recording layer. Thus, the coating of the present invention is provided by a mixture of substantially non-foaming hollow gas-containing spherical particles preferably of a thermoplastic synthetic polymer and a filler of inorganic pigment-providing particulate material, such as provided by a mixture of sized clay particles of a single or various clays, dispersed in a liquid binder. The binder serves to hold the pigments on the paper surface, contributes to the holdout of the thermal coating, and is of a sufficient quantity to provide for adequately mixing the composition constituents to assure a substantially uniform distribution of the hollow spherical particles and the filler particulates in the coating and for permitting the application of an essentially smooth coating and an essentially uniform thickness on a single surface of the paper base or paper support. The coating composition can be applied to the surface of the paper support and dried by using conventional practices such as by using a blade coater followed by air drying and hot surface drying at temperatures up to about 270° F.

The thermal insulating coating is applied to the paper base so that it has a smooth surface. The smoothness of coating is preferably increased to about 0.6 to 1.6 microns (as measured using the Parker Print Surf technique at 10 KgF and using a neoprene backing) by calendering the coated paper at suitable pressure in one or more nips of a suitable calendering machine. The smoothness of the coating is important in thermal printing operations for achieving good "thermal contact" between the thermal printing head and the thermosensitive recording layer. The use of hollow synthetic polymer spherical particles that are relatively plastic during the application of a load thereon permits surface calendering to be achieved at a relatively low pressure in the range of about 300 to 600 pli for providing a desired level of surface smoothness without compromising the thermal insulating properties of the coating. However, attempts to increase the surface smoothness by employing calendering pressures much higher than about 300 pli tend to disrupt some of the spherical particles and/or to "over compact" the spherical particles and thereby decreasing the number of thermal insulating voids provided by and between the hollow spherical particles. Preferably, the calendering is provided in two calender nips mounted in tandem at similar nip pressures in the range of about 300 to 600 pli, preferably 300 pli, and a speed of about 1500 to 2500 FPM, preferably 2000 fpm. A comparison of calendering at nip pressures of 300/300 pli and 1500/1500 pli at a speed of approximately 1900 FPM on the density of the image is provided below for illustrating the effect that calendering at different pressures has upon the image density. The calendering operation is preferably achieved in a calender having a "soft" roll with a thermoplastic cover of about 90–92 Shore D hardness and backed up by smooth-surfaced steel roll. The first and second nips are preferably set at a temperature of about 150° F. and 160° F., respectively. During calendering, the coating which contains about 3 to 7 percent moisture, is contacted by two soft nip calenders. The calendering improves the coating smoothness without significant reduction in sheet thickness. A smoother sheet provides better contact with the heating elements in the fax machine. Maintaining sheet thickness helps keep the heat at the surface where it is needed.

The weight of the thermal insulating coating of the present invention has a direct influence upon the image density obtained during low energy thermal printing operations other factors being equal. Coating weights in the range of about 2 to 10 lbs per 3000 $ft^2$, preferably about 6.5 lbs, provide adequate thermal insulation and aqueous holdout of the thermosensitive recording layer for achieving high quality image density. With a coating weight less than about 2 lbs the thermal insulation and aqueous holdout is not sufficient to provide a desirable level of image density. On the other hand, with a coating weight greater than about 8 lbs the image densities show no improvement over and are, in fact, not as desirable as those obtainable at lower coat weights.

The hollow gas-containing spherical particles useable in the insulating coating of the present invention are of a diameter less than 1 micron, preferably about 0.55 micron or less, and may be formed of synthetic polymers such as styrene acrylic co-polymer, glass bubbles, and structured clay. Preferably, the hollow spherical particles are formed of styrene acrylic co-polymer in a particle size range of about 0.40 to 0.55 microns since air entrapment by such hollow spherical particles is believed to be better than with hollow spherical particles formed of other polymers and since this polymer provides acceptable pigmenting properties, which together with the pigment provided by the clay filler, obviates the need for incorporating relatively expensive pigments such as titanium dioxide in the coating. Suitable commercially available hollow spherical particles of the preferred polymer are commercially available from Rohm and Haas Company as Ropaque OP-62 (0.4 micron diameter sphere with a void volume of 33% and a solids content of 37%), Ropaque OP-84 (0.55 micron diameter sphere with a void volume of 20%, a solids content of 40%, and a thicker shell than Ropaque OP-62), and Ropaque OP-90 (0.45 micron sphere with 33% void volume and a solids content of 37%). Ropaque HP-91 from Rohm and Haas also is acceptable. Hollow gas-containing spherical particles with an average particle size of 0.5 microns are commercially available as Lytron 2501 from Morton International as well as those formed from the other polymers listed above can be used alone or in combination with the spherical particles of the preferred polymer to provide a coating exhibiting adequate thermal insulating and holdout properties for use in the coating of the present invention.

The concentration of the hollow spherical particles in the thermal insulating coating is that which will provide sufficient thermal insulation to the coating to provide desired image density. The concentration of a particular type of hollow spherical particle in the coating formulation is dependent upon various characteristics of the hollow spherical particle such as size, wall thickness, solids content, and void volume which are different in different types of hollow spherical particles. For example, a concentration about 10 to 25 parts, by weight, of the Ropaque OP-84 (0.55 micron) spherical particles in the coating formulation provides an adequate level of thermal insulation and pigmenting for achieving desired image density. However, based on the quantity of entrapped air, the principal mechanism providing the thermal insulation, 6.98 parts of the Ropaque OP-62 (0.4 micron) was found to be equal to 8.4 parts of the Ropaque OP-84. Thus, the concentration of the Ropaque OP-62 spherical particles, and similarly the Ropaque OP-90 spherical particles, in the coating formulation is less than that required for the Ropaque OP-84 and is in the range of about 10 to 25 parts by weight.

The filler used in the thermal insulating coating is provided by using particles of clay such as kaolin, delaminated clay, calcium carbonate, structured clay and titanium dioxide. These pigment-providing clays fill the interstices between adjacent hollow spherical particles for providing the coating with a smooth surface and a uniform dispersion of pigments in the coating. The concentration of the clay particles used in the coating formulation is sufficient to provide a coating with a relatively smooth surface which can be enhanced by calendering. Normally, a concentration of about 50 to 80 parts, by weight, of the clay particles is adequate for this purpose.

Preferably, the filler is provided by using two clays of a different particle size in substantially equal proportions. The two component filler may be provided by the same type of clay or different types of clays. The first clay component of the two-clay filler is preferably provided by using a medium sized delaminated clay in a concentration in the coating formulation of about 30 to 50 parts by weight, preferably 40 parts. The second clay component of the filler is provided by a clay of a size of about 55% to 75%<2 microns (#4 or #5) and in a concentration in the coating formulation of about 30 to 50, preferably about 40 parts, and preferably in an amount substantially corresponding to that of the first clay component. Satisfactory results have been achieved by using 40 parts delaminated clay (Nuclay, available from Englehard) as the first clay component and #5 clay (PDM, available from Dry Branch Kaolin Company) as the second clay component.

By using a two-clay filler in the coating formulation, a highly smooth coating is provided. In this two-clay coating, it is believed that the larger particle size of the PDM spaces the platelets of NuClay. Also, it is believed that PDM provides a desirable level of pigment packing for enhancing the thermal insulating properties of the coating by effectively filling the interstices between the hollow thermoplastic spherical particles. In any event, the presence of the two-clays adjacent the outermost surface of coated product provides the means whereby only this outermost surface may be densified, thereby enhancing the ability to obtain the desired smooth and planar surface provided by the present coating.

The binder used in the thermal insulating coating include polymers such as latexes, styrene butadiene, acetate acrylic, vinyl acetate, polyvinyl alcohol, casein and protein. The binder is used in the mixture of clay and spherical particles in concentrations which will provide for uniform distribution of coating components in a suitable mixer, such as a Kady or Cowles Dissolver, and which will provide a dispersion or slurry of sufficient viscosity to permit application of the coating-mixture into a surface of the paper support by a suitable apparatus such as a bevelled blade operation. Concentrations of binder in the range of about 10 to 20 parts, preferably about 14 to 16, satisfactorily provide the aforementioned goals for the binder. The binder is preferably a styrene butadiene latex (Dow 620 or Dow 640 available from Dow Chemical Co.).

If desired, a non-foaming agent such as DF122NS (available from Henkel) or Foammaster 2500 (available from Henkel) can be added to the coating formulation in a concentration of about 0.1% to 0.3 % parts, by weight on pigment. Also, a viscosity controlling agent such as sodium alginate (Scogin MV) may be added to the coating formulation to adjust the viscosity thereof at a level providing desired blade pressure during the application of the coating formulation onto a paper support. About 0.1% to 0.3 % parts, by weight, of sodium alginate is adequate to provide the formulation with a viscosity sufficient to provide coatings of 8 lbs or less. A dispersant such as Daxad 30 (available from W. R. Grace) may be used in the coating formulation to help keep the pigments separated. An agent such as Bercen 4095 (available from Bercen) is preferably added to the coating formulation in a concentration of about 0.5 to 1.5 parts to help the flow properties at the blade. Ammonia and water as well as blue and red dyes may be added to the coating formulation as needed for pH, viscosity, solids, and color control.

In order to provide a more facile understanding of the principals of the present invention, several examples of coating formulations and comparisons of image densities provided thereby are set forth below. In these examples different coating formulations, coating weights, and calendering pressures are utilized. Also, in each of the coating formulations, the mixtures were prepared by subjecting the formulation to thorough mixing for a duration of about ½ hour. Further, Daxad 30 (0.1 part), Scogin MV (0.2 part), Bercen 4095 (1.0 part), and DF122NS (0.3 part) were added to all formulations except the 71A formulation (control) where it had 0.1 part of DF122NS added. All parts are by weight.

EXAMPLE 1

| Control Coating Formulation 71A | |
|---|---|
| NuClay | 50 parts |
| PDM | 50 parts |
| Dow 620 | 16 parts |

The coating formulation 71A does not contain hollow spherical particles and is used for image density comparison purposes. The coating weight is 6.5 lbs per 3000 $ft^2$.

EXAMPLE 2

| Thermal Insulating Coating Formulations 79A, 80A, 80B, 82C | |
|---|---|
| NuClay | 40 parts |
| PDM | 40 parts |
| Dow 620 | 16 parts |
| Ropaque OP-84 | 20 parts |

The coating formulation 79A was applied to a paper support at a weight of 5.5 lbs, coatings 80A and 80B were provided on paper supports at a weight of 6.5 lbs, and coating 82C was provided on a paper support at a weight of 4.5 lbs. Coating 80A differs from coating 80B by calendering the coating 80A in tandem calendering nips at 300/300 pli at a speed of 1500 FPM while coating 80B was subjected to tandem calendering nips at 1500/1500 pli at a similar speed.

EXAMPLE 3

| Thermal Insulating Coating Formulation 113A | |
|---|---|
| NuClay | 38.1 parts |
| PDM | 38.1 parts |
| Dow 620 | 16 parts |
| Lytron 2501 | 23.8 parts |

This coating formulation uses the spherical particles of Lytron 2501 instead of the Ropaque OP-84 or OP-62 spherical particles utilized in the other coating formulations for demonstrating the differences in air trapping capabilities of the hollow spherical particles with respect to improving the image density of the coatings. The Lytron 2501 particles do not lose the liquid contained therein upon drying and therefore provides a basis for comparing liquid-filled and air-filled particles in the coating.

EXAMPLE 4

| Thermal Insulating Coating Formulation 138A | |
|---|---|
| NuClay | 42.5 parts |
| PDM | 42.5 parts |
| Dow 620 | 16 parts |
| Ropaque OP-84 | 15 parts |

This coating was provided at a weight of 6.5 lbs.

EXAMPLE 5

| Thermal Insulating Coating Formulation 124A | |
|---|---|
| NuClay | 40 parts |
| PDM | 40 parts |
| Dow 620 | 12 parts |
| Ropaque OP-84 | 20 parts |

This coating was provided at 6.5 lbs by using a smaller concentration of binder.

EXAMPLE 6

| Thermal Insulating Coating Formulation 102 | |
|---|---|
| Nuclay | 41.2 parts |
| PDM | 41.2 parts |
| Dow 620 | 15.8 parts |
| Ropaque OP-84 | 17.5 parts |

This coating was provided at a weight of 6.5 lb by using a smaller concentration of hollow spherical particles.

EXAMPLE 7

| Thermal Insulating Coating Formulation 107A, 108B, 108C | |
|---|---|
| Nuclay | 41.7 parts |
| PDM | 41.7 parts |
| Dow 620 | 16 parts |
| Ropaque OP-62 | 16.6 parts |

The coating 107A was a 5.5 lbs whereas the coatings 108B and 108C were 6.8 lbs. The coating 108B differs from coating 108C in that coating 108B was calendered with dual calender nips at 1500/1500 pli while coating 108C was not subjected to any calendering.

In order to compare the various coating formulations as described above, sheets of 25 lb paper were coated with each of these formulations by using a fountain applicator and a blade metering device. Drying of the coatings was achieved by hot air floation. The calendering of the coated paper, except coating 108C, was provided in tandem calender nips with the first nip temperature being at 150° F. and the second nip being at 160° F. at nip pressures of 300/300 and 1500/1500 at a calender speed set at 1500 fpm.

A low energy facsimile coating was applied to each of the coated papers. The low energy facsimile coating was provided by a blend of two individual slurries which were separately ground, mixed, and diluted to a coatable formulation. The first slurry was formed of 19% of a fluorine-type color former, 36% clay filler, 41% inorganic white pigments, and 4% polyvinyl acetate, by weight. The second slurry employed 33% of a phenol-type developer, 49% of an ester-type sensitizer, 7% inorganic white pigments, 6% lubricant, and 5% polyvinyl acetate. The first mixture of the individual slurries was ground for 60 minutes at 200 rpm in a ball grinder while the second slurry was ground in the grinder for 60 minutes at 250 rpm. Equal portions of the first and second slurries were combined with additional polyvinyl acetate to provide the blend with a total of 12% polyvinyl acetate and about 30% solids. The coating was laid down on each coated paper substrate by Meyer rods to provide a coating weight of 2.0 to 2.2 lbs/1300 $ft^2$ and then dried at 50° C. for about 1 minute in a circulating oven. The resulting coated papers were then calendered in a tandem nip arrangement by operating the first calender at a pressure of about 35 pli and the second nip at 27 pli at a speed of about 25 fpm in order to smooth the surface of the applied low energy facsimile coating.

The finished thermal printing papers were then subjected to comparison tests by employing a standard test chart with varying gray tones which was "faxed" from a "3M" low energy facsimile machine to a "Cannon" FAX-270 facsimile machine. The Cannon machine is a low energy machine utilizing 100 watts±20% in the copy mode. The coated papers were sequentially hand fed into the Cannon machine as the images were delivered. The image densities obtained in the form of varying dot coverage over the surface of the thermal printing papers by the developing of the thermosensitive layer applied on the various intermediate coatings are set forth below in the following Table. The higher the number in this Table the better the image development.

TABLE

| | IMAGE DENSITIES | | | | |
|---|---|---|---|---|---|
| Coating | 100% dot | 80% dot | 60% dot | 40% dot | 20% |
| 80A | 1.19 | 1.20 | 1.21 | 0 | 0 |
| 108B | 1.16 | 1.14 | 1.18 | 0 | 0 |
| 80B | 1.18 | 1.19 | 1.17 | 0 | 0 |
| 108C | 1.19 | 1.16 | 1.17 | 0 | 0 |
| 124A | 1.13 | 1.14 | 1.15 | 0 | 0 |
| 82C | 1.16 | 1.19 | 1.17 | 0 | 0 |
| 79A | 1.15 | 1.16 | 1.17 | 0 | 0 |
| 138A | 1.17 | 1.16 | 1.16 | 0 | 0 |
| 102A | 1.17 | 1.14 | 1.14 | 0 | 0 |
| 113A | 1.14 | 1.14 | 1.11 | 0 | 0 |
| 71A | 1.11 | 1.13 | 1.11 | 0 | 0 |
| 107A | 1.12 | 1.10 | 1.13 | 0 | 0 |

As shown in this Table, the coating formulation 80A provided the best thermal insulating and holdout coating for use as a substrate for receiving thermosensitive recording layers useful in low energy thermal printing operations. It will appear clear from these comparisons that several other coating formulations of the present invention, when at desired coating weights and calendered, provide sufficient image density for coated substrates useful in low energy facsimile or other thermal printing operations. However, care should be exercised to use adequate coating weights. For example, coating 107A (5.5 lb) is the same formulation as coatings 108B and 108C but only has a slight advantage in image density over the control coating 71A. Also, the calendering of the coated paper at lower nip pressure (coating 80A) provides better image density than achieved by calendering the same coating formulation at a higher nip pressure (coating 80B.

It will be seen that the present invention provides a coated paper substrate which is particularly suitable for providing a base paper for receiving thermosensitive recording layer and for use in low energy thermal printers such as used in facsimile machines and calculators.

I claim:

1. A method of manufacturing a thermal printing paper useful in relatively low heat thermal printing operations, consisting essentially of the steps of:

providing a paper sheet having opposite essentially flat parallel surfaces, applying to a surface of the paper sheet a base coating of substantially uniform thickness comprising hollow gas-containing spherical particles, a filler of pigment-providing clay or clay component particles, and a binder, said base coating being applied to the surface of the paper sheet in an amount sufficient to provide a dry coating weight in the range of about 2 to 10 lbs per 3000 $ft^2$, calendaring the coated paper at a nip pressure of less than about 1200 pli to increase the smoothness of the base coating to from about 0.6 to about 1.6 microns as measured by the Parker Print Surf technique at 10 KgF using a neoprene backing, and applying a thermosensitive recording layer on the base coating after the coated paper is calendared to provide a composite consisting essentially of a paper sheet with the base coating between the paper sheet and the thermosensitive recording layer, wherein the resulting composite, upon the application of heat to discrete areas of the thermosensitive recording layer by a low energy thermal printer, develops a visible image in the discrete areas having improved image density as compared to similar coated paper which does not contain the spherical particles.

2. The method of claim 1, wherein the hollow gas-containing particles are selected from the class comprising of styrene acrylic co-polymer, glass bubbles and structured clay, wherein the hollow spherical particles are of a diameter less than or equal to about one micron, and wherein the hollow spherical particles are in the dispersion in a concentration of from about 10 to about 25 parts by weight.

3. The method of claim 2, wherein the hollow gas-containing spherical particles are formed of styrene acrylic co-polymer, are in the coating in a concentration of from about 10 to about 25 parts by weight, and are of a particle size less than or equal to about 0.55 micron.

4. The method of claim 2, wherein the filler of pigment providing clay or clay component particles comprises particles having a differing range of particle size and selected from the class of pigment-providing particles comprising, kaolin, delaminated clay, calcium carbonate, structured clay and titanius dioscide, and wherein the particles are in the dispersion in a concentration of about 30 to 90 parts by weight.

5. The method of claim 4, wherein the pigment-providing clay or clay component particles are provided by at least two clays provided by one or more clays selected from said class of clays, and wherein said at least two clays are each of a substantially non-overlapping particle size ranges.

6. The method of claim 5, wherein said at least two clays are in the dispersion in substantially similar concentrations by weight.

7. The method of claim 1, wherein the binder is selected from styrene butadiene, acetate acrylic, vinyl acetate, polyvinyl alcohol, casein and protein.

8. The method of claim 1, wherein the step of increasing the smoothness of the coating comprises calendaring the coated paper sheet in at least one calendar nip at a nip pressure in the range of about 300 to 600 pli to smooth the exposed surface of the coating.

9. The method of claim 8, wherein the at least one calendar nip comprises two calendar nips mounted in tandem, and wherein the calendaring is provided at a speed of from about 1500 to about 2500 fpm.

10. The method of claim 1, wherein the paper sheet is formed at least substantially of cellulosic fibers and is of a weight basis in the range of about 20 to 35 lbs per 3000 $ft^2$.

11. The method of claim 1, wherein the thermosensitive recording layer comprises a color former and a developer.

* * * * *

UNITED STATES PATENT AND TRADEMARK OFFICE

CERTIFICATE OF CORRECTION

PATENT NO. : 5,342,649

DATED : August 30, 1994

INVENTOR(S) : Steven D. Sarokin

It is certified that error appears in the above-indentified patent and that said Letters Patent is hereby corrected as shown below:

column 4, line 3 , change "therehal" to --thermal--.

column 9, line 23, change "floation" to --flotation--.

column 10, line 33, change "80B" to --80B)--.

column 11, line 22, "titanius dioscide" to --titanium dioxide--.

Signed and Sealed this

Eighth Day of November, 1994

Bruce Lehman

*Attest:*

BRUCE LEHMAN

*Attesting Officer*

*Commissioner of Patents and Trademarks*